United States Patent [19]

Borseth et al.

[11] Patent Number: 4,826,618

[45] Date of Patent: May 2, 1989

[54] STABLE DETERGENT EMULSIONS

[75] Inventors: Donald Borseth, Plymouth; David McCall, Detroit, both of Mich.

[73] Assignee: Diversey Corporation, Mississauga, Canada

[21] Appl. No.: 71,619

[22] Filed: Jul. 9, 1987

Related U.S. Application Data

[63] Continuation-in-part of Ser. No. 582,267, Feb. 22, 1984, abandoned.

[51] Int. Cl.[4] ..... C11D 17/00

[52] U.S. Cl. ..... 252/174.21; 252/174.22; 252/174.24; 252/546; 252/DIG. 2; 252/DIG. 14

[58] Field of Search ..... 252/135, 174.21, 174.22, 252/174.24, 546, DIG. 2, DIG. 14

[56] References Cited

U.S. PATENT DOCUMENTS

| | | | |
|---|---|---|---|
| 3,208,949 | 9/1965 | Bosnati | 252/DIG. 14 |
| 3,328,309 | 6/1967 | Grifo et al. | 252/DIG. 14 |
| 3,509,059 | 4/1970 | Renold | 252/174.24 |
| 3,591,508 | 7/1971 | Huggins et al. | 252/135 |
| 3,629,125 | 12/1971 | Payne et al. | 252/135 |
| 3,708,436 | 1/1973 | Thompson et al. | 252/135 |
| 3,764,559 | 10/1973 | Mizuno et al. | 252/135 |
| 3,829,386 | 8/1974 | Wegst et al. | 252/135 |

FOREIGN PATENT DOCUMENTS 1126479 9/1968 United Kingdom .

*Primary Examiner*—Paul Lieberman
*Assistant Examiner*—Willie J. Thompson
*Attorney, Agent, or Firm*—Arnold S. Weintraub

[57] ABSTRACT

A stable detergent emulsion composed of:

(a) a free nonionic surfactant selected from the group consisting of alkylene oxide adducts of polyhydric compounds, alkyl aryl ethoxylates, alcohol ethoxylates and mixtures thereof;

(b) a polymeric emulsion stabilizer for the free nonionic surfactant, wherein the polymeric emulsion stabilizer is the reaction product of a reactant compound selected from the group consisting of unsaturated carboxylic acids, polycarboxylic acids, and mixtures thereof polymerized in the presence of a water-soluble nonionic surfactant; and (c) water.

17 Claims, 1 Drawing Sheet

STABLE DETERGENT EMULSIONS

Cross-Reference to Related Applications

This application is a continuation-in-part of Ser. No. 582,267, filed on Feb. 22, 1984, now abandoned the disclosure of which is hereby incorporated by reference.

BACKGROUND OF THE INVENTION

1. Field of the Invention

The present invention concerns detergent compositions. More particularly, the present invention concerns stable detergents in the form of emulsions. The present invention also concerns stable detergent emulsion compositions which contain unusually low and high levels of nonionice surfactants. Even more particularly, the present invention pertains to detergent emulsions containing components which are stable in highly caustic environments.

2. Description of Relevant Art

Stable detergent emulsions have long been known. Conventionally, these emulsions are prepared by mixing together selected nonionic surfactants, with or without detergent "builders", and a partially esterified maleic acid copolymer which is used to stabilize the active organic ingredient in the aqueous phase. The use of the partially esterified maleic acid copolymer is described in U.S. Pat. No. 3,591,508.

One major problem inherent in the use of partially esterified maleic acid copolymer stabilizers is the instability of such stabilizers in highly alkaline solutions. The addition of salts of alkali metals to compositions containing such stabilizers triggers their hydrolysis to non-useful forms.

It is to be appreciated through, that prior art detergent emulsions contain relatively low levels of nonionic surfactant as the active organic ingredient. Conventionally, system limitations inherently preclude the incorporation of greater than about fifteen percent, by weight, of active organic ingredient. Ordinarily, nonionic surfactants are present in such emulsions in a range of about five to fifteen percent. Above this level of active organic ingredient, instability of the system occurs. This precludes the employment of such emulsions in heavy industrial usage, such as industrial laundries.

As is known to those skilled in the art to which the present invention pertains, conventionally, elevated levels or organic ingredient are necessary in industrial laundries. Based upon recent technology, many industrial laundries employ powder detergents since these contain greater than twenty-five percent, by weight, of nonionic surfactant. Currently, where liquid build detergents are used, the laundries employ an admixture of a liquid nonionic surfactant dispersed in a solvent, which is commonly referred to as a "nonionic oil". Then, separately, and apart from the liquid system there is added to the laundry a liquid "builder", in order to enhance detergency. Based upon the disparity of percentages of active ingredient between liquids and powders it is most difficult for a liquid built detergent to compete with a powder built detergent in industrial laundry usage, both from cleaning ability and economy of use.

As will subsequently be detailed, the present invention overcomes the lower level active ingredient problem in the prior art by providing liquid detergent emulsions which have unusually high levels of nonionic surfactant incorporation therewith.

SUMMARY OF THE INVENTION

The present invention is a stable detergent emulsion which includes:

(a) a first free nonionic surfactant selected from the group consisting of alkylene oxide adducts of polyhydric compounds, alkyl aryl ehtyoxylates, alcohol ethoxylates and mixtures thereof:

(b) a polymeric emulsion stabilizer, the emulsion stabilizer being the reaction product of a reactant compound selected from the group consisting of acrylic acid, short-chain polycarboxylic acids, and mixtures thereof and a water soluble nonionic surfactant reacted together in the presence of an initiator; and (c) water.

Optionally, water soluble builders selected from the group consisting of alkali metal polyphosphates, alkali metal salts of nitrilotriacetic acid, alkali metal salts of ethylenediaminetraacetic acid, polymeric polycarboxylates and mixtures thereof can also be included.

The present invention contemplates a stable detergent emulsion having both low and high levels of nonionic surfactant present therewith, wherein the free nonionic surfactant has a cloud point ranging from insoluble at room temperature to about 180° F. (82° C.).

In accordance with the present invention, the free nonionic surfactants are stabilized in the emulsion by the incorporation of a polymeric phase stabilizer prepared by the polymerization of an unsaturated acrylic acid or a short-chain polycarboxylate in an aqueous alkaline media in the presence of a nonionic surfactant. In preparing the polymeric phase stabilizer employed in the present invention, suitable amounts of the unsaturated acrylic acid or short-chain polycarboxylate are admixed in an aqueous media together with a nonionic surfactant and a suitable chemical initiator to begin and maintain the polymerization reaction.

The present invention, further, contemplates the incorporation into the emulsion of other surfactants such as anionic surfactants, amphoteric surfactants and the like, as well as mixtures thereof.

It should further be noted with respect hereto that by the incorporation of the elevated amounts of free nonionic surfactant, there is a concommitant reduction in the amount of builder which can be incorporated into the detergent emulsions and vice versa. Thus, the present invention provides both built and non-built stable detergent emulsions.

By practicing the present invention, stable emulsions can be prepared incorporating nonionic surfactants over a broad range of surfactant concentrations from fractions of a percentage on up. Indeed, percentages as low as 0.5% are in excess of fifteen percent, and up to, typically, forty-five percent by weight, of free nonionic surfactant can be present in the emulsion hereof.

For a more complete understanding of the present invention reference is made to the following detailed description and accompanying examples.

BRIEF DESCRIPTION OF THE DRAWING

The drawing is a graph showing the specific gravity of an emulsion of the present invention vs. centrifuge gravities as evidence of emulsion stability.

DESCRIPTION OF THE PREFERRED EMBODIMENTS

Figure 1:
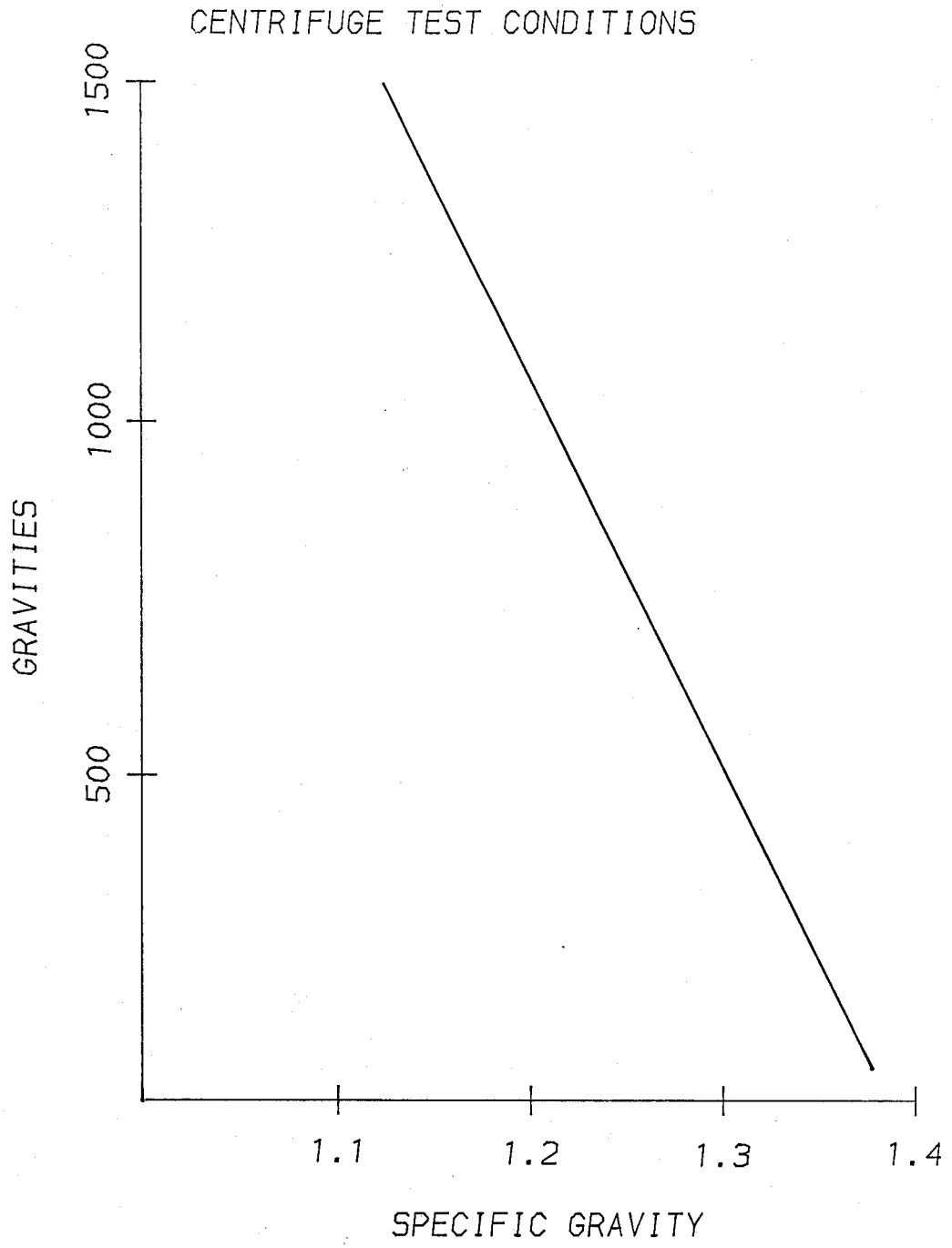

As hereinabove noted, the present invention provides stable detergent emulsions which can contain various concentrations of free nonionic surfactant. The emulsions exhibit remarkable stability even in highly alkaline media or the presence of high concentrations of alkaline salts. Additionally, emulsions having unusually high levels of nonionic surfactant, i.e. greater than about fifteen weight percent, of nonionic surfactant can be obtained.

The present invention is founded upon the unexpected discovery that incorporation of a polymeric emulsion stabilizer produced by the polymerization of an unsaturated acrylic acid or a short-chain polycarboxylic acid in an aqueous media in the presence of a nonionic surfactant will permit incorporation of both low level and unusually high levels of additional unpolymerized free nonionic surfactants, into stable emulsions.

Additionally, it was found that incorporation of this particular class of polymeric emulsion stabilizers with free nonionic surfactants will yield emulsions stable at high levels of solution alkalinity.

The detergent emulsions hereof can be either "built" or "non-built", depending upon the nonionic surfactants to be incorporated as free nonionic surfactants in the emulsion. With the incorporation of free nonionic surfactants which are, generally, insoluble or which have a low cloud point, it may not be necessary to have a built emulsion, while at the higher cloud point values it is necessary to build the emulsion to obtain a stable formulation. In general, free nonionic surfactants having a cloud point below about room temperature need not be made into built emulsions.

It should be noted that the term "emulsion" as used herein and in the appended claims means both micro emulsions and macro emulsions. The term "free nonionic surfactant" as employed in this description, is defined as nonionic surfactants which are not chemically bonded to or associated with the polymeric emulsion stabilizer.

As shown in the drawing, the "stability" of emulsions according to the present invention is specific gravity related vis-a-vis the testing therefor. Low level surfactant - high builder emulsions, evidence little or no separation at room temperature and above. However, because of the density differences between the surfactant (above lg/ml) and the external phase (about 1.3 g/ml) these emulsions separate when centrifuged at high gravities. Thus, as shown in the drawing, emulsions having a specific gravity of 1.1 g/ml or less can be centrifuged at about 1500 gravities for about 30 to 60 minutes while exhibiting less than 6% separation. Emulsions having a specific gravity of about 1.28 g/ml can only be centrifuged at about 500 gravities or less. Centrifuging emulsions having a specific gravity about 1.38 g/ml is not a valid test for storage stability.

To complete phase separation testing emulsions should be able to withstand hot box testing for at least 30 days at a temperature of at least about 120° F.

It has been found that by employing the emulsion stabilizers hereof, "stable" detergent emulsions are produced.

In addition to emulsions containing low levels of incorporated nonionic surfactants, stable emulsions having greater than about fifteen percent, by weight, free nonionic surfactant based on the total weight of the emulsion, can be prepared. Generally, the free nonionic surfactant will be present in the emulsion in an amount ranging from about 0.5 to about 45 percent, by weight, based on the total weight of the emulsion. The amount is dependent upon the application for which the emulsion is formulated. For example, ware washing solutions may contain as little as 0.5 percent by weight free nonionic surfactant whle heavy-duty textile cleaners may contain up to 45 percent by weight. In heavy-duty textile detergent emulsions, the free nonionic surfactant will, generally, be present in an amount ranging from about 15 percent, by weight, to about 45 percent, by weight, based on the total weight of the emulsion. Preferably, such heavy-duty emulsions will contain free nonionic surfactant in amounts gre ater than 15 percent and less than about 40 percent by weight.

The polymeric emulsion stabilizer used in the detergent emulsion of the present invention is employed in an amount effective to form a stable emulsion. Preferably, this amount is between about 0.20 and about 5 percent by weight emulsion stabilizer based on the total weight of the emulsion on an anhydrous basis. As an aqueous solution, however, the stabilizer is present in a weight-to-weight ratio of between about 1:1 to 1:30 with respect to the free nonionic surfactant.

As noted, the polymeric emulsion stabilizer employed in the present invention is produced by admixing a reactant compound selected from the group consisting of unsaturated acrylic acids, polycarboxylic acids and mixtures thereof in water at concentrations between about 5 percent by weight and about 40 percent by weight based on the total weight of the solution.

The reactant compound is, generally, selected fro the group consisting of acrylic acid, polyacrylic acid, copolymers of maleic anhydride and methylvinyl ether, copolymers of maleic anhydride and ethylene, copolymers of maleic anhydride and styrene, copolymers of acrylic and maleic anhydride, and mixtures thereof. Preferably, the reactant compound is selected from the group consisting of acrylic acid, polyacrylic acid and mixtures thereof. Where polyacrylic acid is employed it generally has a molecular weight below about 500,000. The polyacrylic acid generally has a molecular weight below about 40,000 to about 200,000; preferably below 50,000. Suitable polyacrylic acids are commercially available from B. F. Goodrich under the trade name GOODRITE K-722.

Also admixed in the solution is a nonionic surfactant present in an amount between about 0.4 and about 45 percent, by weight, surfactant. The amount of nonionic surfactant added to the solution and adapted to be chemically associated with the polycarboxylate polymer to be formed will vary depending on the levels of free nonionic surfactant to be incorporated in the emulsion. The nonionic surfactant adapted to be bound preferably is selected from the group consisting of alcohol ethoxylates, alkyl aryl ethoxylates, products of the condensation reaction of ethylene oxide and propylene oxide, and ethylenediaminetraacetate, adducts of ethylene oxide and propylene oxide, ethoxylated-propoxylated phosphate esters, alkylene oxide adducts of polyhydric compounds and mixtures thereof. Preferably, the surfactant employed is an alkyl aryl ethoxylate and mixtures thereof. An example of one class of compounds which can be employed successfully in the preparation of the modified polymeric emulsion stabilizer is the nonylphenol ethoxylates.

The nonionic surfactant chosen for preparation of this polymeric emulsion stabilizer generally has a cloud point between about room temperature and about 212° F. (about 25° C. to about 100° C.); preferably between about 180° F. and about 200° F. (about 82° C. and about 93° C.). In general, where surfactants having cloud points in the higher portion of the preferred range are employed, higher temperatures and increased surfactant concentrations can be employed effectively. Where surfactants having lower cloud point values are employed, lower reaction temperatures and decreased surfactant concentrations can be used.

Initiation of polymerization may occur by a variety of methods. Generally, a chemical compound is added to the solution as an initiating agent. The amount of chemical initiator used in polymerization is related to the molecular mass of the polymer to be generated. The polymeric emulsion stabilizers employed in the detergent emulsion of the present invention, preferably, have molecular mass between about 5000 and about 200,000. To obtain a polymer having a molecular mass in this range initiator, in an amount between about 0.1 and about 2.5 percent by weight based on the total solution concentration can be used.

The chemical initiator used is selected from the group consisting of alkali metal persulfates, ammonium persulfate, azobis-(isobutyronitrile), t-butyl hydro-peroxide and mixtures thereof. Such initiators are commonly referred to as oxidizing agents. Coupled initiators may also be successfully employed in the production of the polymeric emulsion stabilizer. Suitable coupled initiators include one of the above-mentioned oxidizing agents coupled with a reducing agent selected from the group consisting of hydrogen peroxide, alkali metal bisulfites, and mixtures thereof. Preferably, the reducing agent is selected from the group consisting of sodium bisulfite, hydrogen peroxide, and mixtures thereof.

The polymerization reaction preferably occurs in acidic aqueous media having a pH between about 2 and about 6. To achieve and maintain the pH of the desired level, alkali metal hydroxides may be added to partially neutralize the carboxylic acid present in solution. Such agents are preferably selected from the group consisting of alkali metal hydroxides and mixtures thereof. In the preferred embodiment, sodium hydroxide is employed.

Polymerization generally occurs at a reaction temperature between about 100° F. and about 190° F. over a period of between about 30 minutes and 24 hours. The polymer produced is water soluble and is present in an aqueous solution and is capable of stabilizing emulsions containing nonionic surfactants. Without being bound to any theory, it is believed that the polymer produced has a polycarboxylate backbone with approximately 1 to 5 percent by weight nonionic surfactant associated chemically therewith. The polymeric emulsion stabilizer is, preferably, maintained in an aqueous medium at a concentration between about 1 and about 40 percent by weight polymer and is employed herein as the aqueous form thereof.

The polymeric emulsion stabilizer in aqueous solution described above may be incorporated into the emulsion composition in an amount ranging from about 10 to about 50 percent by weight of solution based on the total weight of the emulsion in emulsions containing 20 percent by weight free nonionic surfactant. Preferably, the polymeric emulsion stabilizer solution comprises between about 10 and about 40 percent by weight of the total emulsion in compositions containing 30 percent by weight free nonionic surfactant. In emulsions containing less surfactant, lower levels of emulsion stabilizer will be necessary; while higher surfactant levels will necessitate the use of greater concentrations of stabilizer.

The emulsion stabilizers hereof are more particularly described in co-pending U.S. application Ser. No. 078,893, filed 7-29-87, the disclosure of which is hereby incorporated by reference.

It is to be appreciated that the stabilizer is prepared by one of two methods, i.e. the polymerization of acrylic acid in the presence of the nonionic surfactant or the grafting or associating of the nonionic surfactant with an already existent polycarbylic acid, either reaction being conducted in the presence of an initiator. In the former method, the highest concentration of the polymeric emulsions stabilizer in water that can be prepared successfully is less than 15%, by weight, based on the total weight of solution. Using the latter method, in excess of 40%, by weight, of stabilizer can be realized.

The free nonionic surfactant employed in the present invention is selected from the group consisting of alkylene oxide adducts of polyhydric compounds, alkyl aryl ethoxylates, alcohol ethoxylates and mixtures thereof. Generally, these free nonionic surfactants are prepared by the condensation reaction of a suitable amount of ethylene oxide with a selected organic hydrophobic base under suitable oxyalkylation conditions. These reactions are well known and documented in the prior art.

Among the useful free nonionic surfactants typifying the alkylene oxide adducts of polyhydric compounds are the ethylene oxide adducts of ethylenediamine sold commercially under the name "TETRONIC" as well as the ethylene-oxide propylene oxide adducts of propylene glycol sold commercially under the name "PLURONIC". It must be noted that these free nonionic surfactants are employed herein as adjuncts in laundry applications. In ware washing situations these free nonionic surfactants are the only surfactants employed. In laundry or ware washing, this type of free nonionic surfactant is employed in amounts ranging from about 0.5% by weight to about 3.0% by weight based on the total weight of the emulsion.

Other useful, defoaming nonionic surfactants include the alkyl- or aryl- capped alcohol or aryl ethoxylate, which may or may not be capped with propylene oxide. These defoamers are well-known and commercially available under the name TRITON CF, TRITON DF and the like. These defoamers can be used at higher concentrations, i.e. in excess of 15%, as disclosed in the parent application hereof.

Indeed in practicing the present invention the Pluronic or Tetronic-type defoamer is employed where low concentrations of nonionic surfactant is desired in the emulsion. Where high levels of nonionic surfactants are employed the alkyl aryl ethoxylate are employed.

Representative of the alkyl aryl ethoxylates are, for example, the polyethylene oxide condensates of alkyl phenols. The alkyl substituent in such compounds may be derived from polymerized propylene, diisobutylene, octene, or nonene. Examples of compounds of this type include nonylphenol condensed with about two to about nine moles of ethylene oxide per mole of nonylphenol; dodecyl phenol condensed with up to about 10 moles of ethylene oxide per mole of phenol and dinonyl phenol condensed with up to about 15 moles of ethylene oxide per mole of phenol. Commercially available nonionic surfactants of this type include Igepal CO-530 marketed by the GAF Corporation; and Triton X-45, and X-114, marketed by the Rohm and Haas Company.

The alcohol ethoxylate useful herein include the condensation products of aliphatic alcohols with ethylene oxide. The alkyl chain of the aliphatic alcohol may either be straight or branched and generally contains from about 8 to about 22 carbon atoms. Examples of commercially available nonionic surfactants of this type include Tergitol 15-S-3; 15-S-5; Tergitol 25-L-3 and 25-L-5 marketed by the Union Carbide Corporation. Mixtures of alcohol ethoxylates can also be employed.

As noted, nonionic surfactants of the type contemplated for use herein are, of course, well documented. See, inter alia, U.S. Pat. Nos. 3,870,648; 3,629,125; 3,574,122; 3,591,508; 4,247,424, as well as Great Britain Pat. No. 1,124,186 which are incorporated herein by reference.

In practicing the present invention, the preferred nonionic surfactants are the nonylphenol ethoxylates, as well as mixtures thereof.

In preparing the built emulsions hereof any suitable builder can be employed, such as organic-based builders and inorganic builders. Typifying the organic-based builders are, for example, alkanolamines, polymeric polyelectrolytes, an alkali metal salt of a weak acid, nitriloacetic acid, its alkali metal salts, ethylenediaminetetracetic acid, and the like, as well as mixtures thereof.

Typifying the inorganic builders are, for example, the well-known alkali metal phosphate builders, alkali metal hydroxides, such as caustic soda and potassium hydroxide, (which also controls the pH) soda ash, silicates, inorganic sulfates, such as sodium and potassium sulfate, and the like, as well as mixtures thereof.

Generally, the builders, where used, will be present in an amount ranging from about 5 to about 35 percent, by weight, based on the total weight of the emulsion. Preferably, the builders will be present in an amount ranging from about 10 to about 25 percent, by weight, based on the total weight of the emulsion.

Suitable polymeric polyelectrolytes, useful as builders, are, for example, polyacrylates, as well as the GANTREZ-type maleic acid copolymer stabilizers. Useful alkali metal salts of a weak acid include sodium acetate, potassium citrate, etc., and the like, as well as mixtures thereof.

Representative of the inorganic phosphate builders are the alkali metal phosphate salts such as, for example, the alkali metal pyrophosphates such as tetrasodium pyrophosphate, tetrapotassium pyrophosphate, and the like; the acid pyrophosphates such as disodium dihydrogen pyrophosphate, trisodium monohydrogen pyrophosphate, dipotassium dihydrogen pyrophosphate, etc., the tripolyphosphates and acid tripolyphosphates such as sodium tripolyphosphate, potassium tripolyphosphate, tetrasodium monohydrogen tripolyphosphate, tripotassium dihydrogen tripolyphosphate, and so forth; the akali metal tetrapolyphosphates such as hexasodium and hexapotassium tetrapyrophosphate; the alkali metal hexametaphosphates and higher chain length polyphosphates such as those that are present in the sodium potassium, and lithium phosphate "glasses"; and the like. Of these, the hexametaphosphates tetrapotassium pyrophosphate and sodium tripolyphosphate are preferred.

Alkali metal hydroxide, where used, can be employed, also, to neutralize the polymeric electrolytes.

The free nonionic surfactants employed herein can also have other surfactants blended therewith, such as anionic and amphoteric or zwitterionic surfactants as well as minor amounts of other nonionic surfactants.

Among the anionic detergent compounds useful in the compositions of this invention are, for example, the alkali metal salts of long-chain fatty acids having at least 12 carbon atoms, i.e., "soap". Suitable soaps are the sodium, potassium and ammonium salts of fatty acids, derived from oils and fats from vegetable and animal sources.

Also, among the useful anionic detergent compounds ar the water-soluble salts and particularly the alkali metal salts of organic sulfuric reaction products such as the sulfonates and sulfates of alkyl and alkaryl moieties containing from 8 to about 22 carbon atoms in the alkyl portion of the radical. Commercially important are the linear alkyl sulfonate sodium salts such as sodium lauryl sulfonate and the sodium and potassium alkyl benzene sulfonates such as are described in U.S. Pat. Nos. 2,220,009 and 2,477,383. Again, these anionic surfactants are well known in the art.

The zwitterionic surfactants contemplated herein are those based on the alkyl imidazolines, such as the Monoterics sold by Mona, the quaternary ammonium carboxylates and the quaternary ammonium sulfates.

Anionic surfactants where used are present in amounts ranging from about 0.5 to about 12 percent. Amphoteric or zwitterionic surfactants where used are present in amounts ranging from about 0.5 to about 5.0 percent. "Other" nonionic surfactants, where used, are present in amounts ranging from about 0.5 to 3.0 percent.

Furthermore, it should be noted that if the secondary surfactant acts as a hydrotrope for the primary surfactant much less of it can be used since higher levels will de-stabilize the emulsion. For example, alkyl naphthalene sulfonates (small alkyl chain) are good hydrotropes and, therefore, should be used only in amounts up to about 2 percent, whereas sodium LAS is not a good hydrotrope and amounts up to 10 percent have been incorporated without decreasing the emulsions stability.

In formulating the emulsions hereof, it is desirable that a pH level greater than about 7 be maintained. Also, depending on the intended use of the emulsions other additives may be added thereto, such as, microbicides, perfumes, dyes, optical brighteners, germicides, enzymes, and the like.

The emulsions may also be admixed with nonionic oils, solvents, such as Butyl Cellosolve TM glycol ethers and glycols and the like.

The present emulsions can be used as heavy duty detergents especially useful in removing hydrocarbon soils from fabrics such as cotton, polyester or polyester blends, as well as from nonporous surfaces. Also, the emulsions hereof can be used as metal cleaners, as household detergents or the like.

It should, also, be noted that when greater amounts of builders are employed, the cloud point of the nonionic surfactant is so depressed that the surfactant is no longer soluble. Hence, as contemplated herein and as noted above, stable emulsions, whether built or non-built, consist of nonionic surfactants which are essentially insoluble in the external phase of the emulsion.

Following are specific examples of the present invention. In the examples, which are to be construed as illustrative and not limitative of the present invention, all percentages are by weight, absent contrary indications.

EXAMPLE I

A polymer solution suitable for use as an emulsion stabilizer was prepared in the following manner. Polymerizations was carried out in glass vessels equipped with conventional stirrers and heating elements. Nonionic surfactant (3.0g), acrylic acid (6.0g) and sodium hydroxide (0.7g) were dissolved in 91.3 grams of water. The mixture was stirred and heated to 60° C. One gram of sodium persulfate was then added.

After several minutes, an exotherm was noted with the final temperature at 75° C. The mixture was maintained at this temperature until a negative test for alkene was observed. The test for alkene was conducted in the following manner. A few drops of a 2% aqueous solution of potassium permenganate were added to a 0.5 ml aliquot of the reaction mixture diluted to 10 ml. Persistance of the pink permanganate color signalled the end of the reaction.

The resulting material was a clear, faintly yellow solution which was cooled and used in subsequent formulations. This material was designated as Sample A.

EXAMPLE II

A second polymer solution suitable for use as an emulsion stabilizer was prepared in the following manner. Thirty grams of aqueous solution containing 30 percent by weight poly(acrylic acid) available commercially under the trade name GOODRITE K-722 from B.F. Goodrich, was admixed with 66 grams of water and 3.0 grams nonionic surfactant treated with one gram of sodium persulfate for 24 hours at 75° C.

The solution was clear and faintly yellow. This material was designated a Sample B.

EXAMPLE III

A third solution, designated Sample C, was also prepared and used in detergent formulations. Sample C was a physical mixture of 30 grams of poly(acrylic acid) and 3.0 grams nonionic surfactant in 67 grams of water. No subsequent polymerization was performed on this sample.

EXAMPLE IV

Various detergent emulsions were prepared which employed either Sample A, Sample B or Sample C. The detergent emulsion formulations are listed in Table I.

Detergent emulsion stability of the formulations was evaluated by two procedures. The emulsion formulations were each subjected to centrifugal force. The amount of force applied was dependent on the specific gravity of the emulsion under study as calculated by the graph shown in FIG. 1.

Samples of each detergent emulsion were checked for evidence of separation at 5, 15, 30 and 60 minute intervals. The detergent emulsions were considered stable if less than 6 percent separation was observed after 60 minutes of centrifugation. The results are summarized in Table I.

Emulsions were also tested as a function of long-term, high temperature stability. A stable emulsion was defined as one which showed no evidence of separation after four weeks at 45° C.

As can be seen from the data in Table I, the addition of Samples A and B will yield stable detergent emulsions with as little as 3 percent added polymer solution. However, Sample C, in which the nonionic acrylic acid polymer was not formed, did not yield a stable detergent emulsion.

TABLE I

| Component | Formulation A (wt %) | Formulation B (wt %) | Formulation C (wt %) | Formulation D (wt %) |
|---|---|---|---|---|
| Water | 42 | 42 | 42 | 67 |
| Sample A | 15 | 0 | 0 | 3 |
| Sample B | 0 | 15 | 0 | 0 |
| Sample C | 0 | 0 | 15 | 0 |
| Added Nonionic Surfactant[1] | 30 | 30 | 30 | 0 |
| Added Nonionic Surfactant[2] | 0 | 0 | 0 | 1 |
| Sodium Nitrilotriacetate | 10 | 10 | 10 | 20 |
| Sodium Hydroxide | 3 | 3 | 3 | 10 |
| Stability Results | | | | |
| Centrifuge | Pass | Pass | Did Not Emulsify | Pass |
| Hot, shelf-life | Pass | Pass | — | Pass |

[1]Igepal CO-530, a nonylphenol ethoxylate nonionic surfactant, commercially available from GAF.
[2]Pluronic L-61, an ethylene oxide/propylene oxide block copolymer, commercially available from BASF Corporation.

Having, thus, described the invention what is claimed is:

1. A stable detergent emulsion comprising:
(a) a free nonionic surfactant selected from the group consisting of alkylene oxide adduct of a polyhydric compound, alkyl aryl ethoxylate, alcohol ethoxylates and mixtures thereof;
(b) a polymeric emulsion stabilizer for the free nonionic surfactant, wherein said stabilizer is a chemically associated polycarboxylic acid polymeric backbone selected from the group consisting of polyacrylic acid, copolymer of acrylic acid and an ethylenically unsaturated polycarboxylic acid or anhydride thereof, copolymers of ethylenically unsaturated polycarboxylic acid or anhydride thereof with a non-carboxy containing ethylenically unsaturated monomer and a non-ionic surfactant; the reaction product of a reactant compound selected from the group consisting of unsaturated acrylic acid, polycarboxylic acids, and mixtures thereof polymerized in the presence of a water-soluble nonionic surfactant; and
(c) water.

2. The emulsion of claim 1 wherein the free nonionic surfactant is present in an amount between about 0.5 and about 45.0 percent by weight, based on the total weight of the stable detergent emulsion.

3. The emulsion of claim 1 wherein the free nonionic surfactant is present in an amount ranging from about 15.0 to about 45.0 percent, by weight, based on the total weight of the stable detergent emulsion.

4. The emulsion of claim 1 wherein the free nonionic surfactant is present in an amount greater than 15.0 percent by weight and less than 45.0 percent by weight based on the total weight of the stable detergent emulsion.

5. The emulsion of claim 1 wherein the free nonionic surfactant is present in an amount greater than 16.0 percent by weight and less than 45.0 percent by weight based on the total weight of the stable detergent emulsion.

6. The emulsion of claim 2 wherein the polymeric emulsion stabilizer is present in a weight to weight ratio of between about 1:1 and about 1:30 of polymeric emulsion stabilizer to free nonionic surfactant, respectively.

7. The emulsion of claim 1 wherein the polymeric emulsion stabilizer is present in an amount between about 0.2 and about 5.0 percent by weight based on the total weight of the emulsion.

8. The emulsion of claim 1 wherein the water is present in an amount between about 40 and about 80, based on the total weight of the emulsion.

9. The emulsion of claim 1 further comprising a detergency builder.

10. The emulsion of claim 10 wherein the detergency builder is selected from the group consisting of alkali metal phosphates, alkali metal hydroxides, alkali metal carbonates, alkali metal bicarbonates, alkali metal triacetates, alkali metal silicates, alkali metal ethylenediaminetetraacetate and mixtures thereof.

11. The emulsion of claim 1 wherein the free nonionic surfactant is selected from the group consisting of alkyl aryl ethoxylates having terminal ethyelene oxide or propylene oxide constituents located thereon, alcohol ethoxylates having terminal ethylene oxide or propylene oxide constituents located thereon, and mixtures thereof.

12. The emulsion of claim 1 wherein the nonionic surfactant is selected from the group consisting of alcohol ethoxylates, alkyl aryl ethoxylates, products of a condensation reaction of ethylene oxide/propylene oxide esters, and mixtures thereof.

13. The emulsion of claim 1 wherein the polymeric emulsion stabilizer contains at least 0.5 percent by weight nonionic surfactant chemically associated with a polycarboxylate backbone in an aqueous solution, based on the total weight of the polymeric emulsion stabilizer.

14. The emulsion of claim 1 wherein the polymeric emulsion stabilizer contains between about 1.0 and about 5.0 percent by weight nonionic surfactant based on total weight of the polymeric emulsion stabilizer.

15. A stable detergent emulsion comprising:

(a) from about 0.5 to about 45.0 percent by weight of a nonionic surfactant selected from the group consisting of alcohol ethoxylates, alkyl aryl ethoxylates, alcohol ethoxylates having terminal alcoholic groups, alkyl aryl ethoxylates having terminal alcoholic groups substituted with an alkylene oxide, and mixtures thereof;

(b) a polymeric emulsion stabilizer for the nonionic surfactant wherein said stabilizer is a chemically associated polycarboxylic acid polymeric backbone selected from the group consisting of polyacrylic acid, copolymer of acrylic acid and an ethylenically unsaturated polycarboxylic acid or anhydride thereof, copolymers of ethylenically unsaturated polycarboxylic acid for anhydride thereof with a noncarboxy containing ethylenically unsaturated monomer, the polymeric emulsion stabilizer present in a weight-to-weight ratio between about 1:1 and about 1:30 stabilizer to free surfactant, respectively; and (c) water.

16. The stable detergent emulsion of claim 15 wherein the nonionic surfactant is present in an amount greater than 15 percent and less than 45 percent by weight, based on the total weight of the emulsion.

17. The stable detergent emulsion of claim 15 wherein the nonionic surfactant has a cloud point between insoluble and 180° F.

* * * * *

UNITED STATES PATENT OFFICE

CERTIFICATE OF CORRECTION

Patent No. 4,826,618 Dated May 2, 1989

Inventor(s) Donald Borseth and David McCall

It is certified that error appears in the above-identified patent and that said Letters Patent is hereby corrected as shown below:

Column 10, lines 55-59
delete "the reaction product of a reactant compound selected from the group consisting of unsaturated acrylic acid, polycarboxylic acids, and mixtures thereof polymerized in the presence of a water-soluble nonionic surfactant;".

Signed and Sealed this

Twenty-eighth Day of July, 1992

*Attest:*

DOUGLAS B. COMER

*Attesting Officer*

*Acting Commissioner of Patents and Trademarks*